US009458744B2

(12) United States Patent
Beyer et al.

(10) Patent No.: US 9,458,744 B2
(45) Date of Patent: Oct. 4, 2016

(54) ENGINE WITH EXTERNAL CAM LUBRICATION

(71) Applicant: FORD GLOBAL TECHNOLOGIES, LLC, Dearborn, MI (US)

(72) Inventors: Theodore Beyer, Canton, MI (US); Forest Heggie, LaSalle (CA); Jonathan Denis Crowe, Northville, MI (US); Ramon Michael Lee, Commerce Township, MI (US); Murray Griffin, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 78 days.

(21) Appl. No.: 14/526,946

(22) Filed: Oct. 29, 2014

(65) Prior Publication Data

US 2016/0123198 A1 May 5, 2016

(51) Int. Cl.

| | |
|---|---|
| ***F01M 1/06*** | (2006.01) |
| ***F01M 9/10*** | (2006.01) |
| ***F01L 1/053*** | (2006.01) |
| ***F01L 1/46*** | (2006.01) |
| *F01L 1/047* | (2006.01) |

(52) U.S. Cl.

CPC ..... *F01M 9/101* (2013.01); *F01L 1/053* (2013.01); *F01L 1/46* (2013.01); *F01M 9/102* (2013.01); *F01M 9/105* (2013.01); *F01L 2001/054* (2013.01); *F01L 2001/0537* (2013.01)

(58) Field of Classification Search

CPC .. F01L 1/053; F01L 2001/054; F01M 9/101; F01M 9/102; F01M 9/105

USPC ..... 123/90.27, 90.33, 90.34

See application file for complete search history.

(56) References Cited

U.S. PATENT DOCUMENTS

| | | | | |
|---|---|---|---|---|
| 4,856,466 | A | 8/1989 | Ting et al. | |
| RE35,382 | E | 11/1996 | Saito | |
| 6,328,009 | B1 | 12/2001 | Brothers | |
| 7,455,040 | B2 * | 11/2008 | Hendriksma | F01L 1/047 123/90.12 |
| 7,913,656 | B2 | 3/2011 | Magnan et al. | |
| 8,166,939 | B2 * | 5/2012 | Lopez-Crevillen | B23B 41/12 123/90.33 |
| 8,464,678 | B1 | 6/2013 | Iskenderian | |
| 2012/0174887 | A1 | 7/2012 | Bartkowicz et al. | |

* cited by examiner

*Primary Examiner* — Ching Chang

(74) *Attorney, Agent, or Firm* — Brooks Kushman P.C.; Greg P. Brown

(57) ABSTRACT

An engine, such as a variable displacement engine, has a camshaft retainer. The camshaft retainer has a cap adapted to cooperate with a carrier to support first and second overhead camshafts for rotation. The retainer cap forms a housing for a camshaft journal bearing. The retainer cap also forms a retainer land defining an open channel adapted to provide a jet of lubricating fluid from the bearing housing to externally lubricate a cam. The retainer land is adapted to mate with a sealing land of the carrier to enclose the open channel.

20 Claims, 4 Drawing Sheets

ENGINE WITH EXTERNAL CAM LUBRICATION

TECHNICAL FIELD

Various embodiments relate to lubrication of a cam of a camshaft of an internal combustion engine.

BACKGROUND

Internal combustion engines have cams, lobes, or rollers that are supported along the length of a camshaft. As the camshaft rotates, the cams either directly, or indirectly via an intermediary mechanism, actuate intake valves or exhaust valves for a combustion cylinder in the engine to convert rotational motion to linear motion. The cams on the camshaft may be positioned at various angles with respect to one another around the camshaft to provide timing for the valve actuation.

A pair of camshafts may be provided to separately actuate the intake valves and the exhaust valves of the engine. The camshafts may be provided within the head of the engine as dual overhead camshafts (DOHC) to interact with followers and actuate the valves. During engine operation, the cams rotate with the camshaft and are in contact a valve poppet or follower. The contact with the follower may cause friction and wear on interfacing surfaces between the cam and the follower, leading to a need to lubricate these surfaces.

SUMMARY

According to an embodiment, a variable displacement engine is provided with an engine block and head defining first and second cylinders, where the second cylinder is adapted to be selectively deactivated during engine operation. An intake overhead camshaft has an intake pair of cams associated with intake valves of the second cylinder. An exhaust overhead camshaft has an exhaust pair of cams associated with exhaust valves of the second cylinder. A camshaft carrier plate and a retainer cap cooperate to support camshaft journal bearings of the intake and exhaust camshafts. The retainer cap defines a channel having an inlet in fluid communication with a lubrication passageway associated with one of the bearings. The channel has a pair of outlets spaced apart from outer surfaces of the exhaust pair of cams for external lubrication thereof.

According to another embodiment, a camshaft retainer is provided with a cap adapted to cooperate with a carrier to support first and second overhead camshafts for rotation. The cap has a housing formed therein for a camshaft journal bearing, and a retainer land defining an open channel adapted to provide lubricating fluid from the bearing to externally lubricate a cam. The retainer land is adapted to mate with a sealing land of the carrier to enclose the open channel.

According to yet another embodiment, a variable displacement engine is provided with a block and head defining first and second cylinders, where the second cylinder is adapted to be selectively deactivated during engine operation. A carrier and a retainer cap are adapted to support at least one overhead camshaft for rotation. The camshaft has a first, internally lubricated cam associated with the first cylinder, and a second, externally lubricated cam associated with the second cylinder. The second cam is lubricated by a passageway defined by the retainer cap.

Various embodiments of the present disclosure have associated, non-limiting advantages. For example, internal lubrication may be difficult to provide for one or more cams of an engine camshaft, i.e. in a variable displacement engine. Previously, a spray bar system has been used to externally lubricate the cams; however control of the lubricating fluid may be difficult, and engine packaging and costs may arise due to the addition of a spray bar component. Cams may be externally lubricated using a jet of lubricating fluid from a channel formed in the retainer cap. The retainer cap cooperates with a carrier plate to support one or more overhead camshafts for rotation within the engine head. The channel in the retainer cap receives fluid from a fluid passageway in the camshaft bearing housing and directs the fluid to externally lubricate the cams to reduce friction and wear on the interface between the cams and the rocking arms or followers for valve actuation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
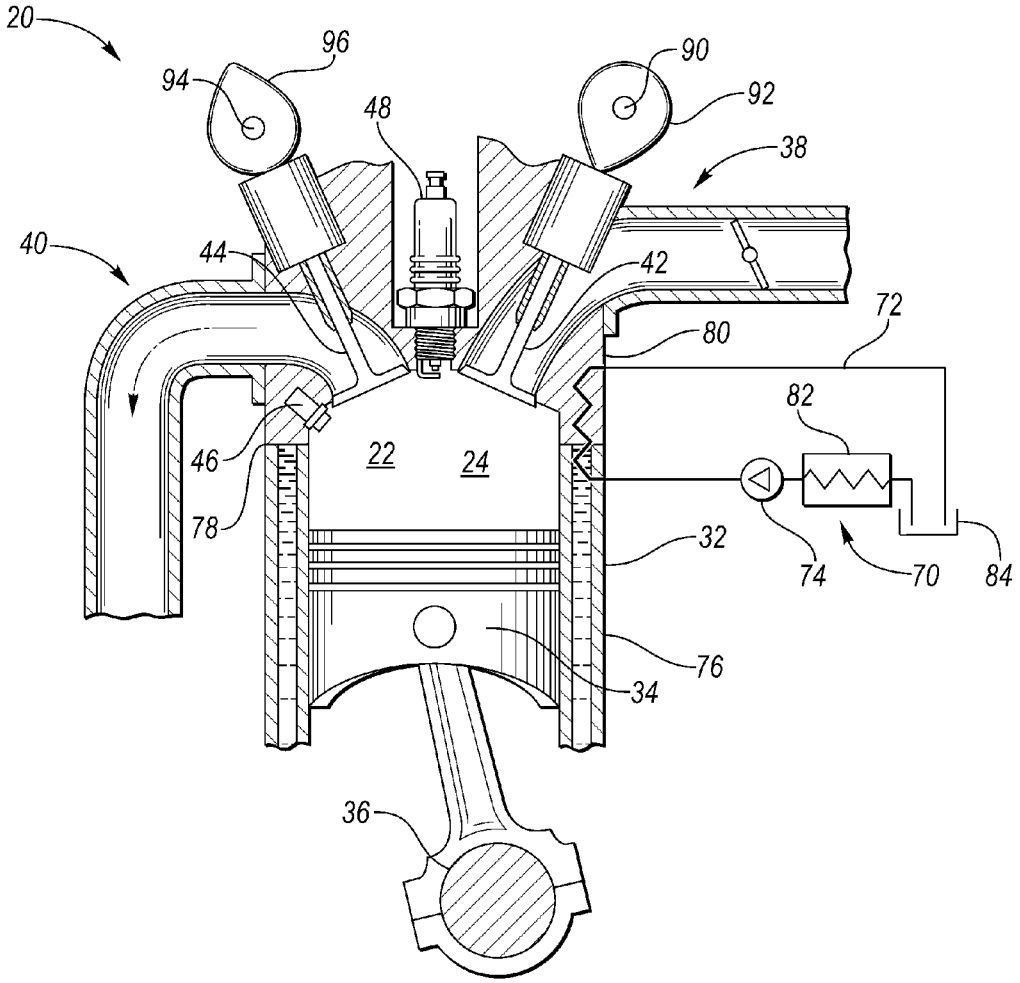
FIG. 1 illustrates a schematic of an engine configured to implement the disclosed embodiments.

FIG. 1 illustrates a schematic of an internal combustion engine 20. The engine 20 has a plurality of cylinders 22, and one cylinder is illustrated. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. One or more intake valves 42 controls flow from the intake manifold 38 into the combustion chamber 24. One or more exhaust valves 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an after treatment system such as a catalytic converter.

The intake and exhaust valve 42, 44 positions and timing, as well as the fuel injection timing and ignition timing may be varied for the various engine strokes.

The engine 20 includes a lubrication system 70 to lubricate various moving components of the engine 20, reduce friction and wear, and prevent overheating. The system 70 may be controlled by a lubrication system controller or the engine controller. The lubrication system 70 may be integrated into the engine 20 with various cast or machined passages in the block and/or head. The lubrication system 70 may contain oil or another lubricant as the working fluid. The system 70 has one or more pumps 74, an oil cooler 82 or other heat exchanger, and a filter. The system 70 may also have a reservoir 84. The lubrication system 70 may provide lubricating fluid to the crankshaft, the camshafts, and other engine components.

The cylinder head 80 is connected to the cylinder block 76 to form the cylinders 22 and combustion chambers 24. A head gasket 78 in interposed between the cylinder block 76 and the cylinder head 80 to seal the cylinders 22. The engine 20 is shown as having a first camshaft 90 associated with the intake valve 42 and having a cam 92 configured to actuate the valve 42. The engine 20 also has a second camshaft 94 associated with the exhaust valve 44 and having a cam 96 configured to actuate the valve 44. The camshafts may 90, 94 may be positioned within the head 80 as dual overhead camshafts (DOHC). In alternative embodiments, the engine 20 may have only a single camshaft to control valves for a cylinder, four camshafts for an engine in a v-configuration, etc. The cams 92, 96 may be oriented at different angles relative to one another to open and close the intake and exhaust valves at different times during engine operation. Additionally, the shape or outer profile of the cams 92, 96 may be varied to control the duration or the lift of the valve.

The engine may be operated as a variable displacement engine (VDE) by deactivating one or more of the cylinders during engine operation. The engine may be operated at a reduced displacement by deactivating one or more cylinders in the engine to improve fuel economy and/or reduce emissions, for example, during light load operation of the engine. A controller may deactivate one or more cylinders in the engine by disabling fuel flow or injection to the cylinder and/or by disabling valve actuation for the cylinder. For example, rocker arms or followers may be decoupled from the associated intake and/or exhaust valves by hydraulic control of lash adjusters and a latching mechanism. The lash adjusters may be in fluid communication with the engine lubrication system 70.

Figure 2:
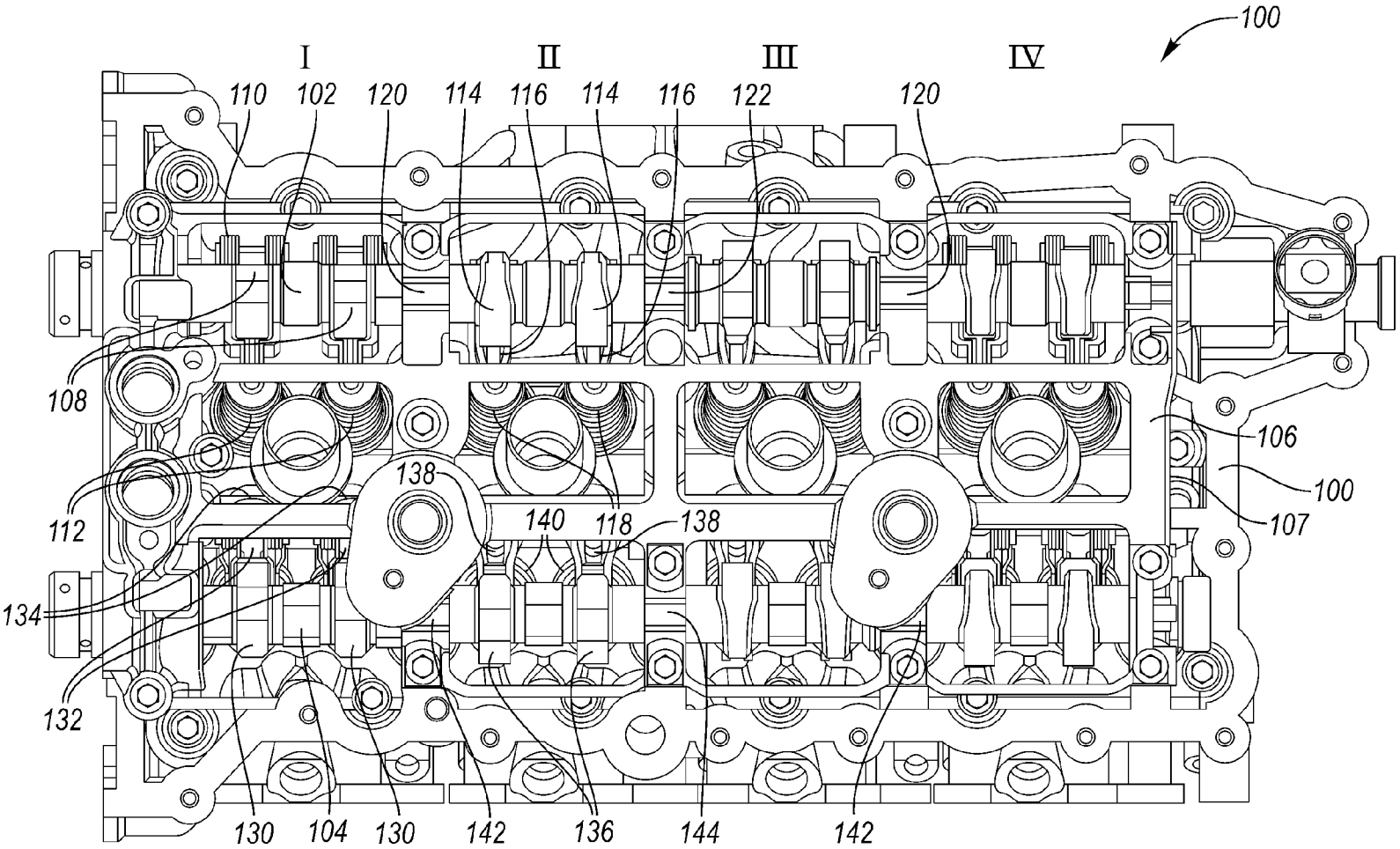
FIG. 2 illustrates a schematic of a top view of an engine head showing the camshafts and lubrication system according to an embodiment.

FIG. 2 illustrates an engine head 100 with a cover removed to show the overhead camshafts, camshaft support structure, and the lubrication system. The engine head 100 may be used with the engine as described above with respect to FIG. 1. The head 100 is configured for an in-line, four cylinder engine, although it may be configured for use with other engines having greater or fewer number of cylinders, and in various arrangements. Cylinders one through four are generally indicated by numerals I, II, III, and IV. The engine head 100 is adapted for use with a variable displacement engine where cylinders I and/or IV may be selectively deactivated, and cylinders II and III remain active during engine operation. In other examples, other cylinders may be configured for selective deactivation, or the head 100 may be configured for use with a convention engine where no cylinders are selectively deactivated during operation.

A first, or exhaust camshaft 102 is positioned on the exhaust side of the head 100. A second, or intake camshaft 104 is positioned on the intake side of the head 100. The camshafts 102, 104 are supported by a carrier 107 that supports journal bearings or the like for the respective camshaft. The camshafts 102, 104 are secured into the carrier by a retainer cap 106, also known as a camshaft retainer cap, which is formed by another plate structure. The carrier and the retainer 106 may have a ladder structure. The carrier 107 is immediately beneath the retainer 106 in FIG. 2.

The exhaust camshaft 102 has a pair of cams associated with the pair of exhaust valves of each cylinder. In FIG. 2, the camshaft 102 has a pair of cams 108 associated with cylinder I. The cams 108 interface with rocker arms 110 or another mechanism to actuate exhaust valves 112. The rocker arm mechanisms 110 may each include a hydraulic lash adjuster or similar feature to selectively deactivate cylinder I and vary the engine displacement. As discussed further below, the cams 108 are externally lubricated during engine operation. The components for cylinder IV may be configured similarly to those of cylinder I.

The exhaust camshaft 102 also has a pair of cams 114 associated with cylinder II. The cams 114 interface with rocker arms 116 or another mechanism to actuate exhaust valves 118. The cams 114 may lubricated in a conventional manner using a lubrication passage that is internal to the camshaft or the follower and exiting on or adjacent to the outer surface of the cams 114. In other embodiments, the cams 114 may be lubricated similarly to cams 108. The components for cylinder III may be configured similarly to those of cylinder II.

The carrier and retainer 106 provide journal bearing supports 120, 122 for the camshaft 102. The journal bearing support 122 may include a lubrication passage providing pressurized fluid from a drill or another passage in the head to the camshaft 102, or alternatively the camshaft may receive lubricating fluid from an end journal bearing housing. The journal bearing supports 120 may provide include a lubrication passage providing pressurized fluid from a drill or another passage in the head to the carrier, as described below.

A first, or exhaust camshaft 102 is positioned on the exhaust side of the head 100. A second, or intake camshaft 104 is positioned on the intake side of the head 100. The camshafts 102, 104 are supported by a carrier (see FIG. 3) that supports journal bearings or the like for the respective camshaft. The camshafts 102, 104 are secured into the carrier by a retainer cap 106. The carrier and the retainer 106 may have a ladder structure.

The intake camshaft 104 has a pair of cams associated with the pair of intake valves of each cylinder. In FIG. 2, the camshaft 104 has a pair of cams 130 associated with cylinder I. The cams 130 interface with rocker arms 132 or another mechanism to actuate intake valves 134. The rocker arm mechanisms 132 may each include a hydraulic lash adjuster or similar feature to selectively deactivate cylinder I and vary the engine displacement. As discussed further below, the cams 130 are externally lubricated during engine operation. The components for cylinder IV may be configured similarly to those of cylinder I.

The intake camshaft 104 also has a pair of cams 136 associated with cylinder II. The cams 136 interface with rocker arms 138 or another mechanism to actuate intake valves 140. The cams 136 may lubricated in a conventional manner using a lubrication passage that is internal to the camshaft or the follower and exiting on or adjacent to the outer surface of the cams 136. In other embodiments, the cams 136 may be lubricated similarly to cams 130. The components for cylinder III may be configured similarly to those of cylinder II.

The carrier and retainer 106 provide journal bearing supports 142, 144 for the camshaft 104. The journal bearing support 144 may include a lubrication passage providing pressurized fluid from a drill or another passage in the head to the camshaft 104, or alternatively the camshaft may receive lubricating fluid from an end journal bearing housing. The journal bearing supports 142 may provide include a lubrication passage providing pressurized fluid from a drill or another passage in the head to the carrier, as described below.

Figure 3:
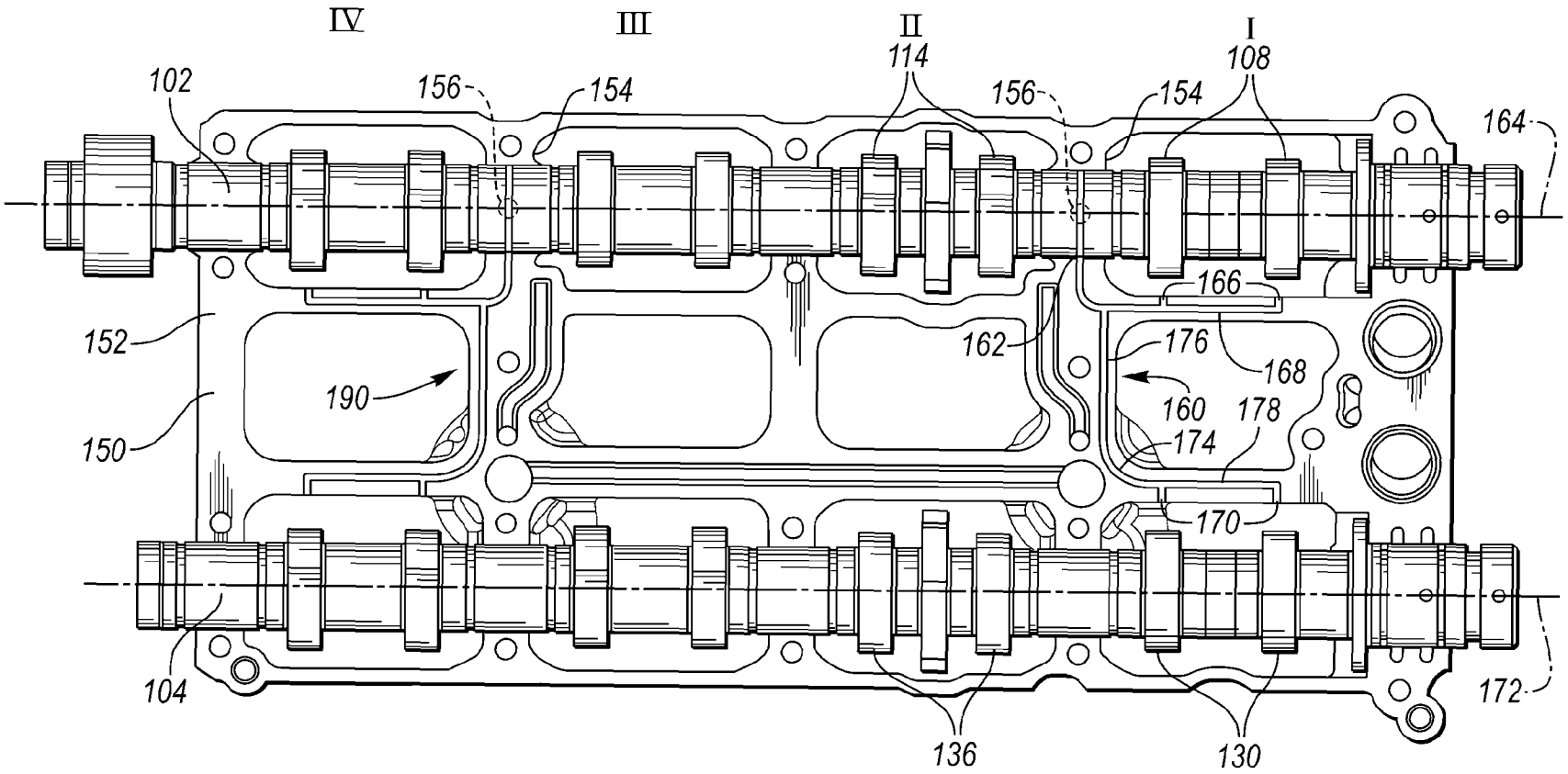
FIG. 3 illustrates a schematic of the camshafts and cam retainer of FIG. 2.

FIG. 3 illustrates the retainer 106, for the camshafts 102, 104. Cylinders I-IV are noted in the figure for reference to FIG. 2. The retainer 106 has a sealing land 152 or surface that mates with a corresponding sealing land or surface of the carrier 107 to retain the camshafts 102, 104. The retainer 106 cooperates with the carrier 107 to support the camshafts 102, 104 for rotation within their journal bearings. The head 100, carrier 107, and retainer 106 are connected to one another when the engine is assembled. A cover is placed over the retainer 106 of FIG. 2 to retain lubricant in the system.

The engine and head 100 has a lubricating fluid system to reduce friction and wear on moving components and to manage heat loads in the engine. The lubricating fluid, such as oil, is typically provided from a reservoir and is pumped into passages within the engine to the components that require lubrication. The passages in the engine may be cast and/or machined into the block and the head.

Cams associated with engine cylinders that are always operating, i.e. cylinders II and III, may be "internally" lubricated using passages that are internal to the camshafts or internal to the followers or rocking arms. In one example, the camshafts have internal fluid passageways with exits that are provided on or adjacent to an outer surface of the cam to lubricate the interface between the rocker arm and the cam for cylinders II and III. In another example, the rocker arms have an internal fluid passageway and exits that are provided on an outer surface of the follower to lubricate the interface between the rocker arm and the cam for cylinders II and III. In other embodiments, the cams associated with cylinders II and III may be externally lubricated as described with respect cylinders I and IV.

The lash adjusters for the rocking arms of the cylinders adapted for deactivation may be controlled hydraulically to selectively deactivate these cylinders. The lash adjusters or other mechanisms used to deactivate the cylinders may be connected into the lubrication system to receive pressurized fluid. The pressurized lubrication fluid is used for control over the cylinder activation and deactivation. Because of the use of the lubrication system for control of the cylinder deactivation in the rocking arm, internal lubrication may not be available for the rocking arms and cams associated with deactivated cylinders. An external spray bar system has been used to externally lubricate the cams for deactivated cylinders. A spray bar may be another engine component that is mounted within the head and is in fluid communication with the lubrication system. In one example, a spray bar includes a manifold of tubing with apertures selectively positioned for lubrication. A spray bar adds additional costs and complexity to the engine, and control over the lubricating fluid distribution and flow may be difficult.

A lubrication channel 160 may be provided in the retainer 106 to direct lubricating fluid to cams, such as cams 108 associated with deactivated cylinders. The channel 160 provides "external" lubrication of the cams, as lubricating fluid is sprayed or jetted onto the outer surface of the cam 108 that interacts with the rocker arm for valve control. In another embodiment, the channel may be provided in the carrier 107, with the sealing land of the retainer enclosing the channel.

Passages in the head 100 for the lubrication system are in fluid communication with a corresponding passage in the journal bearing housings of the retainer 150. The journal bearing housings 154 on the exhaust side of the engine is shown as having the passages 156 below the camshaft 102. The passage 156 is in fluid communication with the channel 160 to provide pressurized lubricating fluid thereto. In other embodiments, the passage 156 may be positioned on the intake side of the engine, or there may be passages on both the intake and exhaust sides of the engine.

The channel 160 is an open channel, or a passageway with three sides and an open fourth side. The channel 160 is enclosed by the sealing land on the carrier plate 107, when the carrier and retainer are mounted together. The retainer or retainer cap 106 may be formed as a plate structure. The retainer 106 may be made from a metal or other material, and may be cast, or otherwise formed. The channel 160 may be cast, machined, or otherwise formed into the retainer 106.

The channel 160 has an inlet 162 or inlet region in fluid communication with the lubrication passageway 154 of one of the bearings. The camshaft journal may have a restrictive groove to control the fluid flow to the channel 160, and in one example, may be on the order of a half a millimeter in depth and/or width. Lubricating fluid flows into the channel 160 through the inlet 162. The inlet region 162 may be oriented or positioned to be generally perpendicular to a rotational axis 164 of a camshaft. The flow within the channel 160 is generally co-planar with the sealing land of the retainer 106.

The channel 160 has outlets associated with one or more cams. In FIG. 3, the channel 160 is shown as having a first pair of outlets 166 or outlet regions spaced apart from outer surfaces of the exhaust pair of cams 108 for external lubrication thereof. In the example shown, the first pair of outlets 166 or outlet regions provide external jets of pressurized lubricating fluid from the channel 160 to the cams 108. The outlets 166 or outlet regions may be oriented or positioned to be generally perpendicular to the rotational axis 164 of the camshaft.

The channel 160 has an intermediate section or region connecting the inlet region to the outlet region. In the example shown, the channel 160 has an intermediate region 168 fluidly connecting the inlet and outlet regions 162, 166. The intermediate region 168 may be positioned to be generally parallel to the rotational axis 164 of the camshaft. As can be seen from FIG. 3, the inlet region 162 and the intermediate section 168 are connected to one another and form a radius of curvature to provide for smooth fluid delivery.

The channel 160 may also have a second pair of outlets 170 spaced apart from outer surfaces of the intake pair of cams 130 for external lubrication thereof. In the example shown, the second pair of outlets 170 or outlet regions provide external jets of pressurized lubricating fluid from the channel 160 to the cams 130. The outlets 170 or outlet regions may be oriented or positioned to be generally perpendicular to a rotational axis 172 of the camshaft 104.

The channel 160 has another intermediate section or region connecting the inlet region to the outlet region. In the example shown, the channel 160 has a second intermediate section 174 fluidly connecting the inlet and outlet regions 162, 170. The intermediate region 174 may have a portion 176 that is generally perpendicular to the axis 164, and another portion 178 that is generally parallel with the rotational axis 164, and another portion. The portions 176, 178 may be connected to one another to form a radius of curvature to provide for smooth fluid delivery. The outlets 170 may be directly connected to the portion 178 of the intermediate section 174. In other embodiments, the intermediate section 174 may be provided as another fluid pathway with a different shape based on the constraints such as the geometry or size of the retainer 106.

The channel 160 may have various cross sectional shapes and areas, and different sections or regions of the channel 160 may have varying cross sectional shapes and areas. For example, each outlet of the first pair of outlets 166 may have a smaller cross sectional area than each outlet of the second pair of outlets 170 to provide for control over the flow restriction, and delivery of the pressurized lubricating fluid to the associated cam. Additionally, the cross sectional area of the outlets 166 may vary or may be common to control the lubricating fluid delivery. The cross sectional area of the outlet regions 166, 170 may be is a minimum cross sectional area for the channel 160 to provide a flow restriction to increase the fluid velocity at the exit of the channel 160.

FIG. 3 also illustrates a second channel 190 similar to channel 160 that provides external lubrication to cams associated with cylinder IV.

Figure 4:
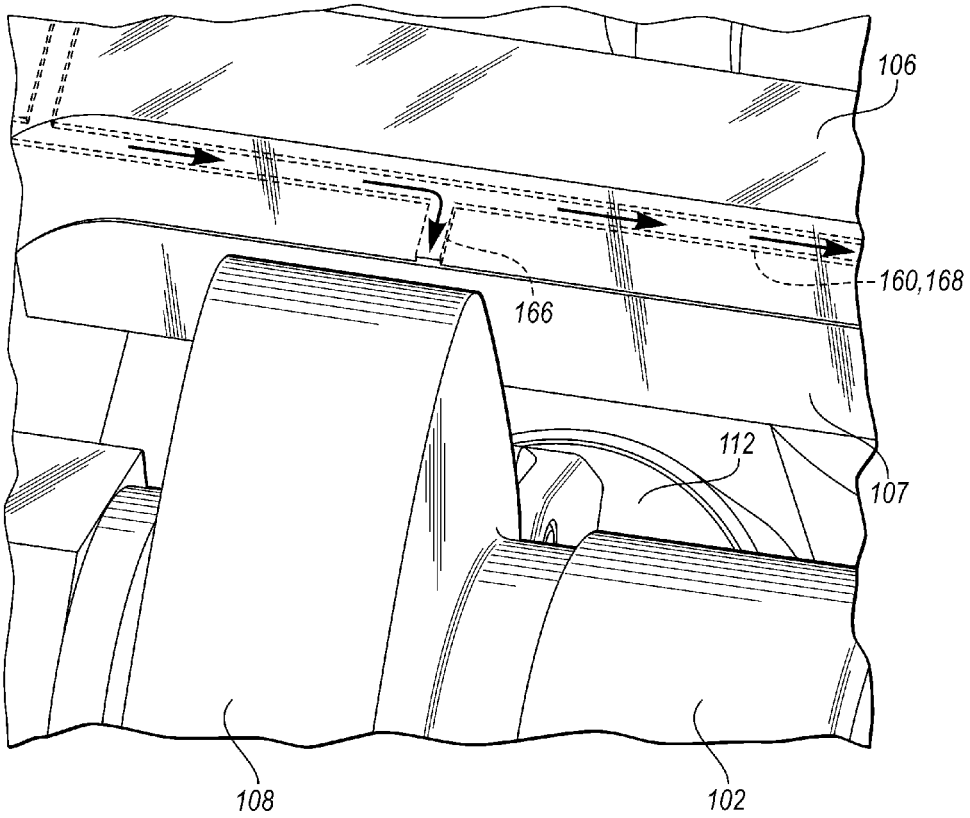
FIG. 4 illustrates a perspective view of a cam and external lubrication passage of FIG. 2.

FIG. 4 illustrates a perspective view of one cam with external lubrication according to the present disclosure. The channel 160 is formed in the retainer 106 and is shown in phantom. The carrier 107 cooperates with the retainer 106 to generally enclose the channel. In the example shown, the fluid travels down the intermediate section 168 of the channel 160 and to one of the outlets 166. The fluid exits the outlet 166 along the edge of the retainer and carrier and forms a jet. The fluid jet externally lubricates the cam 108 as the camshaft 102 rotates. Note that the cam 108 is lubricated both when the cam 108 is actuating valve 112, and when the cylinder is selectively deactivated such that valve 112 is not actuated by cam 108 even as the camshaft rotates.

The outlet 166 is spaced apart from the cam 108 such that it travels across an open space defined between the outer surface of the cam 108 and the edge of the retainer and carrier. Note that the distance between the outer surface of the cam 108 and the edge of the retainer and carrier will vary as the cam rotates, and that the jet of fluid has sufficient velocity and flow to reach the cam through 360 degree of cam rotation.

The outlet 166 may be cast or otherwise formed into the retainer 106. Alternatively, the outlet 166 may be machined into the retainer 106, and may be a saw cut in one example. The outlet 166 has a restricted area both to reduce the volumetric flow of fluid, as well as increase the fluid velocity for the jet.

Various embodiments of the present disclosure have associated, non-limiting advantages. For example, internal lubrication may be difficult to provide for one or more cams of an engine camshaft, i.e. in a variable displacement engine. Previously, a spray bar system has been used to externally lubricate the cams; however control of the lubricating fluid may be difficult, and engine packaging and costs may arise due to the addition of a spray bar component. Cams may be externally lubricated using a jet of lubricating fluid from a channel formed in the retainer cap. The retainer cap cooperates with a carrier plate to support one or more overhead camshafts for rotation within the engine head. The channel in the retainer cap receives fluid from a fluid passageway in the camshaft bearing housing and directs the fluid to externally lubricate the cams to reduce friction and wear on the interface between the cams and the rocking arms or followers for valve actuation While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A variable displacement engine comprising:

a block and a head cooperating to define first and second cylinders, the second cylinder selectively deactivated during engine operation;

an intake overhead camshaft having an intake pair of cams associated with intake valves of the second cylinder;

an exhaust overhead camshaft having an exhaust pair of cams associated with exhaust valves of the second cylinder; and a camshaft carrier plate and a retainer cap cooperating to support camshaft journal bearings of the intake and exhaust camshafts, the retainer cap defining a channel having an inlet in fluid communication with a lubrication passageway associated with one of the bearings, the channel having a pair of outlets spaced apart from outer surfaces of the exhaust pair of cams for external lubrication thereof.

2. The engine of claim 1 wherein the channel in the retainer cap is an open channel, and wherein a sealing land of the carrier plate encloses the open channel.

3. The engine of claim 1 wherein cams associated with valves of the first cylinder are internally lubricated.

4. The engine of claim 1 wherein the lubrication passageway of the one of the bearings is associated with the exhaust overhead camshaft.

5. The engine of claim 1 wherein the inlet to the channel is generally perpendicular to a rotational axis of the exhaust overhead camshaft.

6. The engine of claim 5 wherein the pair of outlets is generally perpendicular to the rotational axis of the exhaust overhead camshaft.

7. The engine of claim 6 wherein the channel defines a first intermediate section fluidly connecting the inlet with the pair of outlets, the first intermediate section generally parallel with the rotational axis.

8. The engine of claim 1 wherein the pair of outlets is a first pair of outlets; and wherein the channel has a second pair of outlets spaced apart from outer surfaces of the intake pair of cams for external lubrication thereof.

9. The engine of claim 8 wherein the second pair of outlets is generally perpendicular to a rotational axis of the intake overhead camshaft.

10. The engine of claim 8 wherein the channel has a second intermediate section fluidly connecting the inlet with the second pair of outlets.

11. The engine of claim 10 wherein a portion of the second intermediate section is generally perpendicular to a rotational axis of the exhaust overhead camshaft; and wherein another portion of the second intermediate section is generally parallel with the rotational axis.

12. The engine of claim 11 wherein the second pair of outlets are fluidly connected to the another portion of the second intermediate section.

13. The engine of claim 8 wherein each outlet of the first pair of outlets have a smaller cross sectional area than each outlet of the second pair of outlets.

14. The engine of claim 1 wherein the pair of outlets have a common cross sectional area.

15. A camshaft retainer comprising:

a cap shaped to cooperate with a carrier to support first and second overhead camshafts for rotation, the cap having formed therein:

a housing for a camshaft journal; and a retainer land defining an open channel to provide lubricating fluid from the camshaft journal to externally lubricate a cam, the retainer land shaped to mate with a sealing land of the carrier to enclose the open channel, the open channel defining an outlet region extending generally perpendicular to a rotational axis of one of the first and second overhead camshafts.

16. The camshaft retainer of claim 15 wherein the open channel has an inlet region in fluid communication with a passageway in the camshaft journal bearing to receive lubricating fluid therefrom, the inlet region positioned to be generally perpendicular to a rotational axis of one of the first and second overhead camshafts.

17. The camshaft retainer of claim 16 wherein the outlet region of the open channel is positioned to be spaced apart from an outer cam surface of the cam to direct an external jet of lubricating fluid thereto.

18. The camshaft retainer of claim 17 wherein the open channel defines an intermediate region fluidly connecting the inlet and outlet regions, the intermediate region positioned to be generally parallel to the rotational axis of one of the first and second overhead camshafts.

19. A variable displacement engine comprising:

a block and a head defining a first cylinder, and a second cylinder selectively deactivated during engine operation; and a carrier and a retainer rotatably supporting an overhead camshaft, the camshaft having a first, internally lubricated cam for the first cylinder, and a second cam for the second cylinder being externally lubricated by a passageway defined by the retainer.

20. The variable displacement engine of claim 19 wherein the second cam for the second cylinder is externally lubricated by the passageway defined by the retainer and opposed to a cam surface of the second cam.

* * * * *